US005581890A

United States Patent [19]

Schmidt

[11] Patent Number: 5,581,890

[45] Date of Patent: Dec. 10, 1996

[54] UTILITY KNIFE

[75] Inventor: Sheldon Schmidt, Paramus, N.J.

[73] Assignee: Great Neck Saw Manufacturers, Inc., Mineola, N.Y.

[21] Appl. No.: 554,257

[22] Filed: Nov. 6, 1995

[51] Int. Cl.[6] ..... B26B 1/08

[52] U.S. Cl. ..... 30/162; 30/2; 30/335

[58] Field of Search ..... 30/162, 2, 335, 30/320

[56] References Cited

U.S. PATENT DOCUMENTS

| | | | |
|---|---|---|---|
| 3,906,627 | 9/1975 | Manning | 30/162 |
| 4,139,939 | 2/1979 | Crooks | 30/2 |
| 4,835,865 | 6/1989 | Knoop | 30/162 |
| 5,012,581 | 5/1991 | Fletcher et al. | 30/162 |
| 5,086,562 | 2/1992 | Jacoff | 30/162 |

FOREIGN PATENT DOCUMENTS

| | | | |
|---|---|---|---|
| 761327 | 10/1963 | Canada | 30/162 |

*Primary Examiner*—Hwei-Siu Payer
*Attorney, Agent, or Firm*—Joseph J. Previto

[57] ABSTRACT

A utility knife having a body portion with a mouth at its front end. A finger piece is provided for moving the blade forward so that it extends from the body portion through the mouth. A spring is provided to retract a blade to a position within the body portion when the finger piece is released. An open hook is provided to stop the forward movement of the blade. The open hook is part of the finger piece and is located rearwardly of the finger piece. The hook strikes a portion of body portion to stop the forward movement of the blade.

8 Claims, 2 Drawing Sheets

UTILITY KNIFE

BACKGROUND

The present invention relates to a utility knife and more particularly to an improved utility knife which is capable of having a knife blade extend from its forward end to cut open boxes, cartons, etc..

In the past, utility knives have been assembled from two matching body halves within which there is provided a knife blade. The two matching halves are adapted to interfit with each other to form the body of the tool and to be held together by any suitable means, such as screws, snap locks, etc. The two matching halves have spaces at their front ends in order to form an open mouth. Mounted within the matching halves of such utility knives is a blade carrier with a blade thereon which is adapted to be moved forwardly by a manually operable pushbutton or the like in order to project the blade through the open mouth to permit the tool to be used. The pushbutton is moved rearwardly to retract the blade within the two matching halves when the tool is no longer in use. Examples of such retractable utility knives are disclosed in U.S. Pat. Nos. 4,930,218; 5,031,322 and 5,086,562, the descriptions and disclosures of which are incorporated herein, by reference.

It has become desirable for safety considerations for the knife blade in such utility knives to be automatically retracted within the holder. In such utility knives, the release of the manually operable pushbutton will automatically retract the blade to a position within the confines of the two halves so that the blade cannot be inadvertently left in its extended exposed position and there is no danger of any injury resulting from such an exposed blade. Examples of such automatically retractable utility knives are disclosed in U.S. Pat. Nos. 3,906,627; 2,550,346; 4,139,939; 5,012,581 and Canadian Patent No. 671,327.

OBJECT

The present invention is an improvement over existing retractable utility knives and has for one of its objects the provision of a retractable utility knife in which the blade is automatically held in its retracted position so that there is no danger that the blade may be inadvertently left in an exposed extended position.

Another object of the present invention is the provision of an improved retractable utility knife in which a manually operable pushbutton is used to extend the blade and in which means are provided for automatically retracting the blade when the pushbutton is released.

Another object of the present invention is the provision of an improved retractable utility knife in which means are provided for automatically stopping the forward movement of the blade beyond a predetermined point when the blade is moved to its forward extended position.

Another object of the present invention is the provision of an improved retractable utility knife which is simple to operate and inexpensive to maintain.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
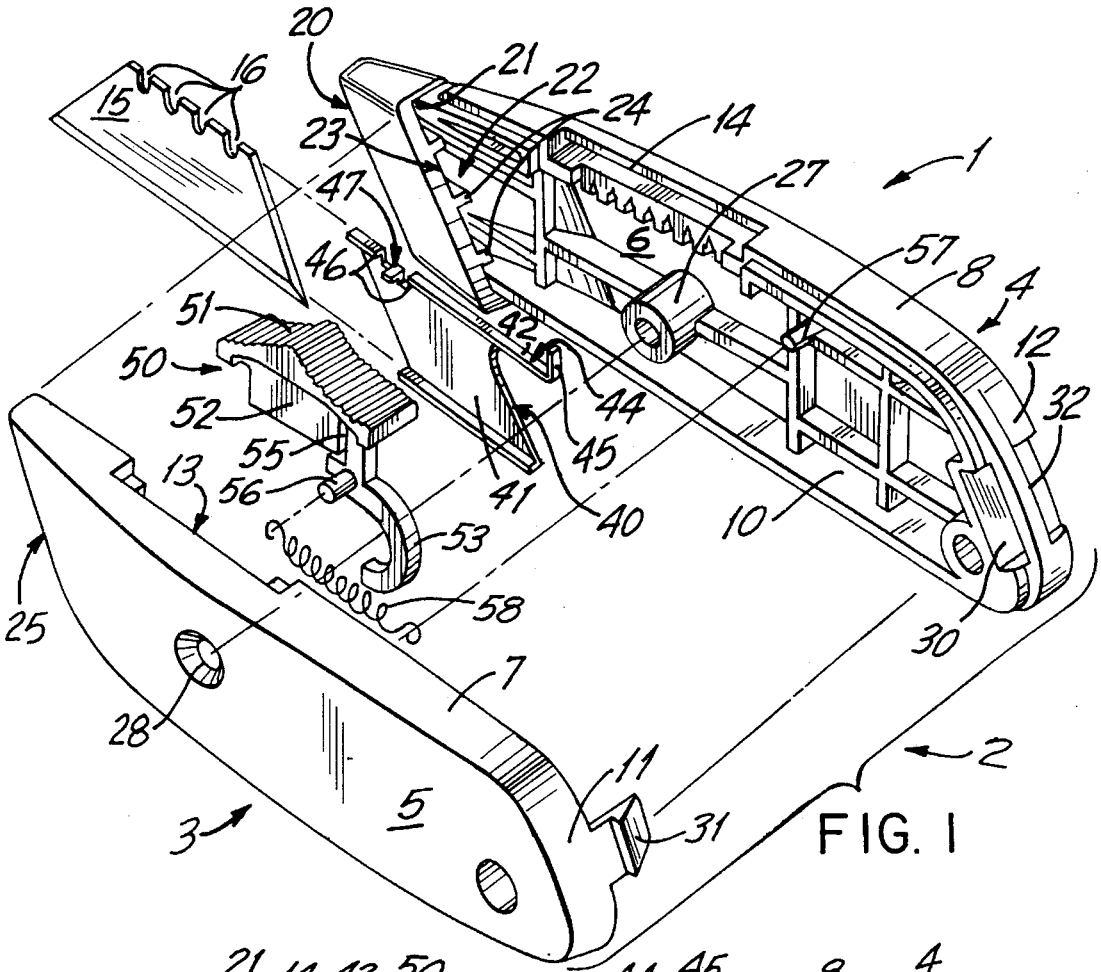
FIG. 1 is an exploded perspective view showing the improved utility knife of the present invention.

The utility knife 1 of the present invention comprises a body 2 made from two matching halves 3 and 4 having side walls 5 and 6, respectively. The halves 3 and 4 are provided, respectively, with top walls 7 and 8, bottom walls 9 and 10 and rear walls 11 and 12. The top walls 7 and 8 have slots 13 and 14, respectively, which match together to permit a finger piece 50 to move along the top walls 7 and 8 and to permit a portion thereof to extend within the interior of the halves 3–4.

At the front end of the body half 4, there is provided a front wall 20 at right angles to the side wall 6 having an elongated front opening therein forming a mouth 21 comprising opposed mouth walls 22 and 23. A plurality of horizontally oriented, vertically spaced ribs 24 extend from and are integral with the inner side wall 23 of the mouth 21 and extend toward the opposite side wall 22. The ribs 24 terminate short of the opposite side wall 22 and leave sufficient space for the blade 15 to move between the ribs 24 and the opposite side wall 22 of the mouth 21. Hence, when the blade 15 is in the extended position, the blade 15 will not wobble or sway from side to side. It will be understood that while the drawings show a plurality of spaced ribs 24, it is within the scope of this invention to use a single horizontal rib 24 rather than a plurality of spaced ribs 24 or to have the ribs oriented differently than as shown in the drawing or to merely have a plurality of protrusions extending from the side wall 23. The half 4 is provided with a boss 27 extending inwardly from side wall 6.

The other body half 3 has a front wall 25 at right angles to the side wall 5 and is provided with a plurality of fingers 26 extending forwardly therefrom. The fingers 26 are adapted to be inserted into the open mouth 21 of the body half 2 between ribs 24 in order to permit the fingers 26 to interlock with rib 24 in the open mouth 21. This anchors the front end of the utility knife so as to prevent the front end from spreading apart. It will be understood that while the drawings show the preferred use of a pair of fingers 26, it is within the scope of this invention to use a single finger 26 or to use more than the pair of fingers 26 shown in the drawings. The fingers 26 which lie between the ribs 24 are thinner in thickness than thickness of the ribs 24 so that they do not interfere with the movement of the blade 15 within the mouth 21. The fingers 26 are shown in the drawings as being preferably thinner than the ribs 24. The half 3 is also provided with an opening 28 which lines up with boss 27 to permit a screw (not shown) to be inserted to hold the two halves together, as may be desired.

As shown in the drawings, the rear walls 11 and 12 are provided with a snap lock assembly 30 (comprising hook 31 on rear wall 11 insertable and interlocking with opening 32 in rear wall 12) which permits the two halves 3 and 4 of the tool 2 to be snapped together. The snap lock assembly is the same as that disclosed in U.S. Pat. No. 5,086,562, the description of which is incorporated herein by reference. The snap lock assembly 30 will lock the halves 3 and 4 together and the front portion of the two halves 3 and 4 are interlocked to each other by the fingers 26 entering the mouth 21 and lying between ribs 24. While the snap lock assembly 30 has been shown as being located on the rear walls 11 and 12 of the two halves 3 and 4, it will be understood that the snap lock assembly may be placed at other locations on the utility knife.

When the two halves 3 and 4 are mounted together with the blade 15 in its retracted position, the fingers 26 are inserted into the mouth 21 between ribs 24 and the snap lock assembly 30 permits the two halves 3 and 4 to be held together The insertion of the fingers 26 between the ribs 24 not only prevents the front end of the two halves 3 and 4 of the utility knife from spreading apart but also prevents the two halves 3 and 4 from moving or sliding relative to each other in any direction. The rear portion of the two halves are then locked together by snap lock assembly 30 so that the two halves 3 and 4 are locked together both at the front and at the rear.

A blade carrier assembly 40 is provided to receive the blade 15. The blade carrier 40 is slidably movable between the two halves 3 and 4 of the closed utility knife in order to move the blade 15 from a retracted position (FIG. 2) to an extended position (FIG. 3) and vice versa. The blade carrier assembly comprises a flat portion 41 having upper and lower walls 42 and 43, respectively, which are substantially parallel to each other and which extend from the upper and lower edges of the flat portion 41 substantially at rights thereto. In the drawing, the flat portion 41 is shown as being substantially shaped like a parallelogram. However, it will be understood that the flat portion may be of any shape such as rectangular, square, etc. The top wall 42 of the blade carrier 40 has a rearwardly extending rear portion 44 with an upstanding tail portion 45. The top wall 42 of the blade carrier 40 has spaced notches 46 therein to form a finger 47 therebetween at right angles to the flat portion 41 which will be received into a blade notch as will be set forth hereinafter below.

The blade 15 is preferably trapezoidal in shape and has notches 16 in its top edge. One of said notches 16 is adapted to receive the finger 47 extending from the top wall 42 of the blade carrier 40 in order to permit the blade carrier 40 to positively grip the blade 15. With this construction, the blade 15 will move forwardly and rearwardly at the same time that the blade carrier 40 moves forwardly and rearwardly.

A finger piece 50 is provided and has a usual finger engaging top portion 51, which may be ribbed, and has a narrower downwardly extending base portion 52 which is adapted to be extended into and between the two halves 3 and 4 through the slot 13–14. The base portion has an L-shaped slot 55 adapted to receive the upstanding tail portion 45 of the blade carrier 40. Hence, when the finger piece is moved back and forth along slot 13–14, the blade carrier 40 and the blade 15 will also move back and forth through the interconnection between blade carrier tail portion 45 and L-shaped slot 55. Extending rearwardly and downwardly from the finger piece 50 and spaced rearwardly from the base portion 52 there is a stop portion 53 in the form of a forward facing, rearwardly and downwardly extending hook. The stop hook 53 is adapted to strike the boss 27 when the finger piece 50 is moved forward to stop the forward movement of the blade carrier 40 and prevent the blade 15 from extending out of the mouth 21 further than a predetermined distance.

The finger piece 50 has a lug 56 extending therefrom. The half 4 also has a lug 57 extending inwardly therefrom in the same direction as lug 56. The lugs 56 and 57 are adapted to receive the front and rear ends of a spring 58. In this manner, after the finger piece 50 is moved forward to expand spring 58 and is released, the spring 58 will contract and move the finger piece 50 together with the blade carrier 40 and the blade 15 rearwardly. Hence, the spring 58 and its associated connections with the finger piece 50, through lugs 56 and 57, respectively, automatically retracts the blade 15 once the finger piece 50 is released.

Figure 2:
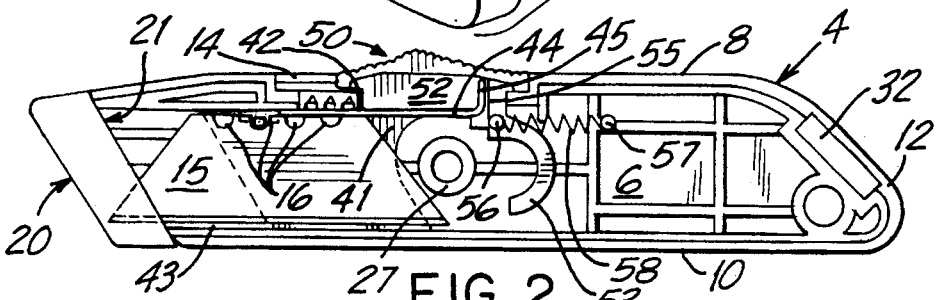
FIG. 2 is a plan view of one of the utility knife body halves showing the blade in its retracted position.
Figure 3:
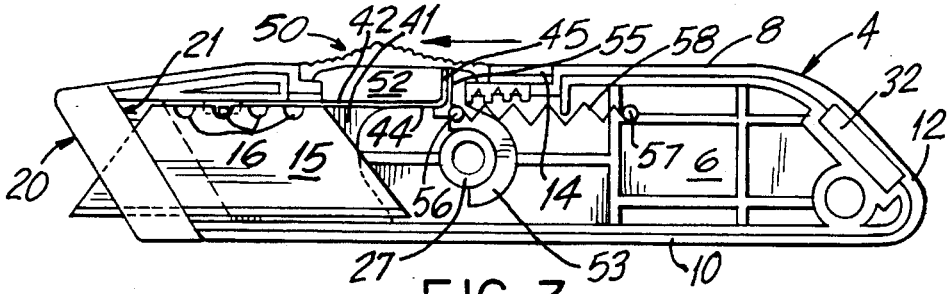
FIG. 3 is a plan view similar to FIG. 2 showing the blade is in its extended position.
Figure 4:
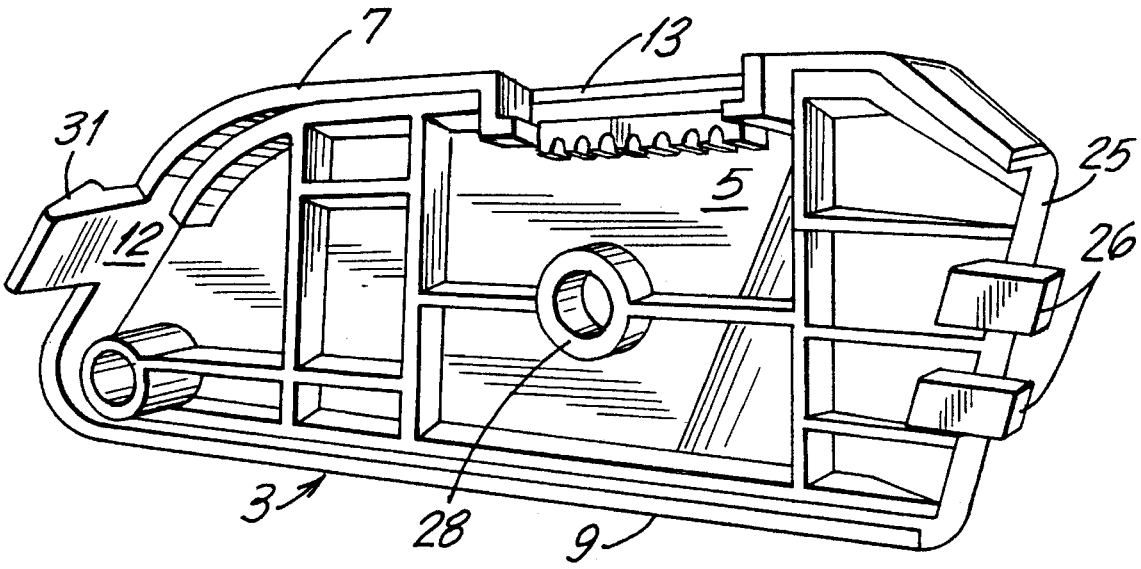
FIG. 4 is a perspective view showing the other body half of the utility knife of the present invention.

In operation the halves 3 and 4 with the blade 15 therebetween are assembled in the manner shown in FIG. 2. The blade 15 has the notch 16 inserted in the finger 47 for positive movement with the blade carrier 40. The two halves 3 and 4 are held together as set forth above. In this position, the utility knife has the blade 15 in its retracted position (FIG. 2). When it is desired to extend the blade 15, the finger piece 50 is pushed forward (as shown in FIG. 3) against the action of the spring 58 (which expands) in order to move the blade carrier 40 with its associated blade 15 forward to expose the front edge of the blade 15 beyond the mouth 21. The rearwardly extending hook 53 strikes the boss 27 and prevents further forward movement of the blade 15. When the finger piece 50 is released, the blade carrier 40 and the blade 15 will be automatically retracted by the contraction of the spring 58.

It will thus be seen that the present invention provides a retractable utility knife in which the blade is automatically held in its retracted position so that there is no danger that the blade may be inadvertently left in an exposed extended position, in which a manually operable pushbutton is used to extend the blade but in which means are provided for automatically retracting the blade when the pushbutton is released, in which means are provided for automatically stopping the forward movement of the blade beyond a predetermined point when the blade is moved to its forward extended position, and which is simple to operate and inexpensive to maintain.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A utility knife comprising a body portion having a mouth at its front end, a blade mounted on said body portion, means for moving the blade forwardly whereby it extends from the body portion through said mouth, means for retracting the blade to a position within the body portion, means for stopping the forward movement of said blade, said stopping means being operatively associated with said moving means, said stopping means being located rearwardly of said moving means, said retracting means comprising spring means, a blade carrier mounted within the body portion, said blade carrier being adapted to receive the blade, said blade carrier being operatively associated with said means for moving the blade forwardly, said forward moving means comprises a finger piece having a portion extending into said body portion, said blade carrier being operatively connected with said finger piece, said stopping means comprises a forwardly facing, rearwardly and downwardly extending open hook.

2. A utility knife comprising a body portion having a mouth at its front end, a blade mounted on said body portion, means for moving the blade forwardly whereby it extends from the body portion through the said mouth, means for retracting the blade to a position within the body portion, means for stopping the forward movement of said blade, said stopping means being operatively associated with said moving means, said stopping means being located rearwardly of said moving means, said retracting means comprising spring means, a blade carrier mounted within the body portion, said blade carrier being adapted to receive the blade, said blade carrier being operatively associated with means for moving blade forwardly, said forward moving means comprises a finger piece having a portion extending into said body portion, said blade carrier is operatively connected with said finger piece, and said finger piece has a slot therein adapted to receive a portion of the blade carrier.

3. A utility knife as set forth in claim 2 wherein said stopping means is mounted on said finger piece.

4. A utility knife as set forth in claim 3 wherein the body portion is provided with a stop element and wherein stopping means strikes said stop element to stop the forward movement of the blade.

5. A utility knife as set forth in claim 4 wherein said stopping means comprises a downwardly and rearwardly of said finger piece.

6. A utility knife as set forth in claim 5 wherein said slot is L-shaped and said portion of the blade carrier is in the form of an upstanding tail to be received in the slot.

7. A utility knife as set forth in claim 6 wherein said spring means comprises a coil spring.

8. A utility knife as set forth in claim 7 wherein means are provided on the finger piece to accommodate one end of the coil spring and wherein means are provided in the body portion to accommodate another end of the coil spring.

* * * * *